US005699858A

United States Patent [19]

McAnally

[11] Patent Number: 5,699,858

[45] Date of Patent: Dec. 23, 1997

[54] WELL PUMPING SYSTEM AND INSTALLATION METHOD

[76] Inventor: Charles W. McAnally, Harvard Station, Sproul Rd., Fort Davis, Tex. 79734

[21] Appl. No.: 617,126

[22] Filed: Mar. 18, 1996

[51] Int. Cl.[6] ..... E21B 23/01; E21B 43/00

[52] U.S. Cl. ..... 166/382; 166/68; 166/106

[58] Field of Search ..... 166/68, 105, 106, 166/107, 242.2, 380, 382

[56] References Cited

U.S. PATENT DOCUMENTS

| | | | |
|---|---|---|---|
| 50,194 | 9/1865 | Wilder | 166/180 |
| 58,468 | 10/1866 | Parker | 166/180 |
| 58,469 | 10/1866 | Parker | 277/34 |
| 2,062,058 | 11/1936 | Howe | 166/106 |
| 3,550,684 | 12/1970 | Cubberly, Jr. | 166/254.2 |
| 4,442,903 | 4/1984 | Schutt et al. | 166/385 |
| 4,523,645 | 6/1985 | Moore | 166/385 |
| 4,744,334 | 5/1988 | McAnally | 119/78 |
| 5,207,726 | 5/1993 | Rathweg | 417/393 |
| 5,336,061 | 8/1994 | Armstrong | 417/411 |

*Primary Examiner*—David J. Bagnell

*Attorney, Agent, or Firm*—Akin, Gump, Strauss, Hauer & Feld, L.L.P.

[57] ABSTRACT

A well pump system including a pulldown anchor which may be lowered into a wellbore on a flexible cable having both ends of the cable retained at the surface until the pulldown anchor reaches a position which will cause a spring biased pawl to prevent the pulldown anchor from being moved upwardly in the well. One end of the cable is then connected to a casing anchor and an elongated casing connected to the casing anchor which is then pulled into the well by the flexible cable. The casing anchor includes a mechanism for actuation upon engagement with the pulldown anchor to cause the casing anchor to be secured in the wellbore and to release the cable for retrieval from the well. The flexible casing is tensioned and secured to the wellhead and a rod actuated pump is then installed in the casing on a tubing string having a hydraulically actuated pump anchor member and release valve connected between the tubing string and the pump so that the pump may be secured in a predetermined position in the casing and released for movement within the casing when desired.

40 Claims, 3 Drawing Sheets

WELL PUMPING SYSTEM AND INSTALLATION METHOD

FIELD OF THE INVENTION

The present invention pertains to a rod actuated well pump system which includes an elongated, continuous, somewhat flexible casing which is installed with a retrievable cable utilizing a pulldown anchor and a casing anchor. A rod actuated pump is secured within the casing by a hydraulically actuated releasable tubing anchor including a mechanically actuated release valve.

BACKGROUND

The extraction of fluids from subterranean reservoirs through wells has been dealt with in many ways using various types of pumping equipment and well support structures, such as casings or liners. The ever-increasing need to utilize land in somewhat arid regions which require extraction of water from subterranean reservoirs through wells has resulted in several somewhat vexatious problems with regard to the cost of drilling and providing suitable well support structures, such as a casing or liner, and suitable pumping equipment which may be conveniently installed in the well and also removed, when necessary, for cleaning or repair.

A significant portion of the cost of providing a source of water in the form of a subterranean well which must be pumped to produce water to the surface pertains to the cost of drilling the well. Well drilling costs are directly proportional to wellbore diameter and the cost of providing a suitable support structure in the well to prevent collapse of the earthen sidewall and to provide a suitable support for an in-the-well pump. Although in-the-well or so-called downhole pumps have been developed in various forms which are basically mechanically uncomplicated and reliable, it is often necessary to remove the pumps for routine servicing and repair as well as to provide for cleaning the wellbore or for deepening the well. Still further, the cost of well casing structure and the time involved in installation of the casing is an important factor in the overall cost of a water well, in particular.

A large number of water wells are drilled to a total depth in the range of three hundred feet to a thousand feet from the surface. The cost of drilling and completing such a well can be significantly reduced if a low cost casing and installation procedure can be provided such as by utilizing somewhat flexible, continuous casing, particularly a type of casing made of a composite or polymer material, such as polyethylene pipe, for example. However, the use of such type of casing presents certain problems in installing the casing in a way which will maintain the casing substantially rigid and straight so that a rod activated downhole pump, in particular, may be installed to produce water or other fluids to the surface.

The present invention has been developed with a view to overcoming the problems associated with prior art wells and pump systems installed therein, particularly for relatively shallow water wells and the like. Those skilled in the art will further appreciate the solution to the above-mentioned prior art problems provided by the present invention as described further herein.

SUMMARY OF THE INVENTION

The present invention provides an improved well pumping system and method of installation, particularly adapted for water wells but useful in other types of fluid producing wells.

In accordance with one aspect of the present invention, a well pumping system is provided which includes a lightweight, preferably continuous and flexible tubular casing which is installed in the well utilizing a casing pulldown anchor and a casing anchor which facilitates installation of the casing with a flexible pulldown cable. Relatively small diameter, shallow water wells can be more effectively completed utilizing a cable anchor and a casing anchor in the arrangement of the present invention for installing a somewhat flexible and preferably continuous casing, also preferably formed of a polymer material such as polyethylene pipe.

In accordance with another aspect of the invention, a well casing installation method and system are provided wherein a casing pulldown anchor is lowered into a well by way of a flexible cable, which anchor automatically is locked in engagement with the wellbore wall at a desired depth, preferably the bottom of the well, and a continuous casing and casing anchor are then lowered into the well and pulled down into a working position. The casing anchor includes lock means for effectively locking the lower end of the casing in place in the well just above the pulldown anchor. The casing anchor includes mechanism for automatically releasing the pulldown cable for retrieval from the well and the casing also includes means at the surface for tensioning the casing to provide a substantially straight casing installation for receiving a downhole pump assembly.

The present invention still further provides a well pumping system, including a casing of a type installed in accordance with the invention, which pumping system includes a rod actuated pump connected to a pump and tubing anchor which is hydraulically actuated and which includes a release valve which may be actuated by the pump activating rod to release hydraulic pressure acting on the anchor so that the pump may be moved within or retrieved from the well, when desired. The rod actuated pump, pump anchor and tubing assembly may be easily installed in, anchored in the well and removed from the well, at will.

The present invention also provides a method of installing a well casing, particularly a flexible continuous casing, for fluid producing wells and a method of installing a downhole pump which includes a hydraulically activated anchor member.

Those skilled in the art will further appreciate the above-mentioned advantages and features of the invention together with other superior aspects thereof upon reading the detailed description which follows in conjunction with the drawing.

DESCRIPTION OF A PREFERRED EMBODIMENT

Figure 1:
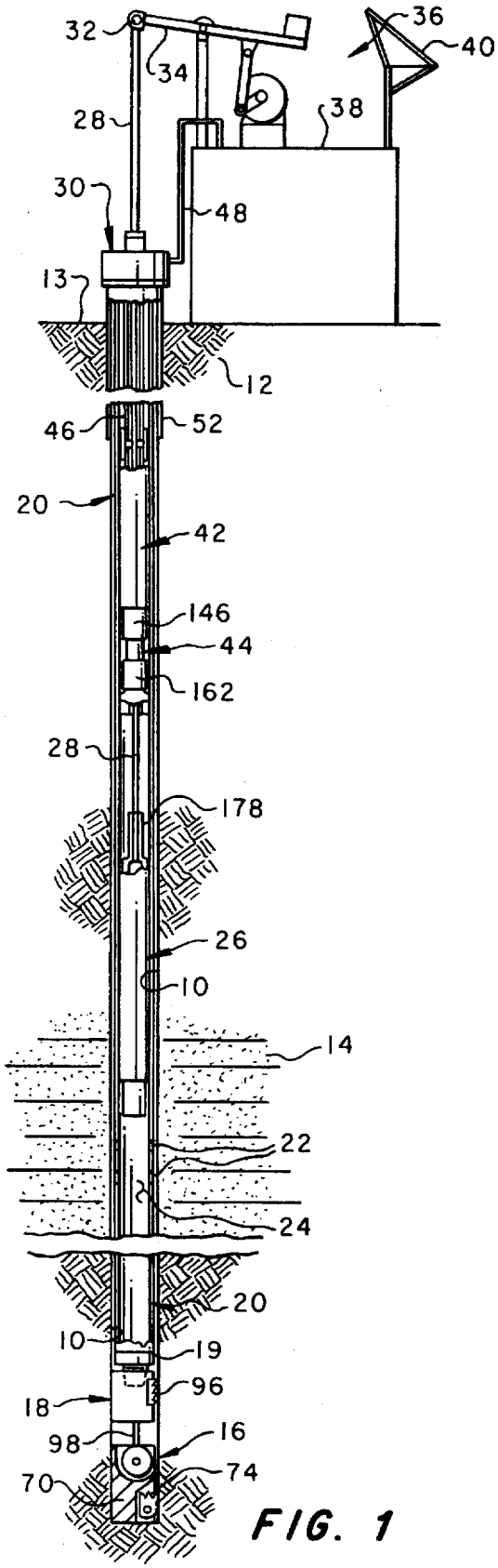
FIG. 1 is a vertical, partial section view of a well pumping system including a casing and casing installation apparatus in accordance with the invention.

In the description which follows, like parts are marked throughout the specification and drawing with the same reference numerals, respectively. The drawing figures are not necessarily to scale and certain elements may be shown exaggerated in scale or in somewhat schematic or simplified form in the interest of clarity and conciseness.

Referring to FIG. 1, there is illustrated a generally cylindrical wellbore 10 which has been drilled into an earth formation 12 and penetrates a fluid producing zone 14, in particular a subterranean aquifer for producing water into the well. The illustration of FIG. 1 shows a completed well installation in accordance with the present invention, which installation includes a casing pulldown anchor 16 and a casing anchor 18 connected to the lower end of an elongated, preferably continuous and somewhat flexible cylindrical casing or liner, generally designated by the numeral 20. The casing 20 is preferably provided with multiple perforations 22 formed therein opening into the wellbore 10 in the region of the aquifer or fluid producing zone 14 so that fluid, such as water, may flow into the interior space 24 of the casing for production to the earth's surface 13 by way of a rod actuated pump, generally designated by the numeral 26.

The pump 26 includes an elongated piston actuating rod 28 which extends to the surface 13 and through a wellhead 30 and is connected at its upper end 32 to a pivot beam 34 of a pump actuating motor, generally designated by the numeral 36. The pump motor 36 is mounted on a reservoir tank 38, which tank also preferably supports a photovoltaic panel array 40 to provide electrical power to the pump motor. The pump motor 36, the reservoir 38 and the photovoltaic array 40 are preferably of the type described in U.S. Pat. No. 4,744,334 issued to Charles W. McAnally on May 17, 1988. Other pump rod actuating mechanisms may, however, be used with the well pumping system of the invention.

Referring further to FIG. 1, the pumping system illustrated also includes a hydraulically actuated pump anchor 42 interposed in the casing 20 and operable to be forcibly engaged therewith for supporting the pump 26 in the casing in the position shown. The pump anchor 42 is connected at its lower end, viewing FIG. 1, to the pump 26 by way of a release valve 44 which will be described in further detail herein. The pump anchor 42 is connected at its opposite end to a tubing string 46 which extends to the wellhead 30 and is suitably connected thereto in a manner to be described. Fluids are lifted from the space 24 through the pump 26 and the release valve 44 and through a suitable passage formed in the tubing anchor 42 and then through the tubing 46 to the wellhead 30 wherein a suitable flowline 48 is connected to the wellhead and to the reservoir tank 38 whereby fluid produced from the aquifer 14 may be stored for use. The general arrangement of the pumping system of the invention just described is particularly adapted for pumping water from subterranean reservoirs or aquifers from relatively shallow wells having a nominal diameter of two and a half to five inches and total depth ranging from three hundred feet to a thousand feet, for example. However, the invention is not limited to wells having these dimensional parameters as those skilled in the art will appreciate.

Figure 2:
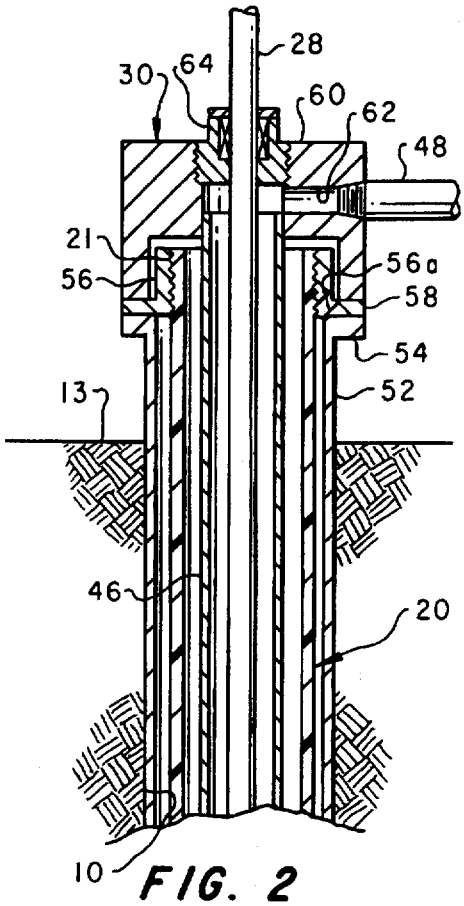
FIG. 2 is a detail section view of the wellhead for the well and pumping system shown in FIG. 1.

Referring to FIG. 2, details of the wellhead 30 are illustrated in accordance with one preferred method of supporting the casing 20 at a wellhead. The wellbore 10 is typically completed after installation of a suitable, cylindrical, surface casing or surface pipe 52 which may be forcibly driven into the wellbore 10 or cemented therein in a conventional manner. The surface casing 52 extends above the surface 13 and has a transverse flange portion 54 formed thereon. In one preferred arrangement for anchoring the upper end of the casing 20, the casing is threaded at its upper distal end as indicated at 21 and is threadedly engaged with a coupling member 56 having a transverse flange 58 engageable with the flange 54. Accordingly, the casing 20 may be anchored at its lower end by the anchor 18 and then tensioned and straightened within the wellbore 10 by threaded engagement with the coupling member 56 and wherein the coupling member is tightened until the casing is suitably tensioned.

As further shown in FIG. 2, the wellhead 30 includes a suitable wellhead member 60 connected to the upper end of the tubing string 46 and engageable with the flange 58 as illustrated. Suitable passage means 62 are formed in the Wellhead member 60 and connected to the flowline 48. A suitable rod packing 64 is also supported on the wellhead member 60 and operably engaged with the reciprocable pump rod 28 in a conventional manner. Other means of securing and tensioning the upper end of the casing 20 may be implemented in accordance with the invention and the specific structure of the wellhead 30 may be modified from that shown. However, the upper end of the casing 20, indicated by the threaded portion 21, may be connected to a suitable coupling member which will permit tensioning of the casing and securement of the casing in the tensioned condition.

Figure 3:
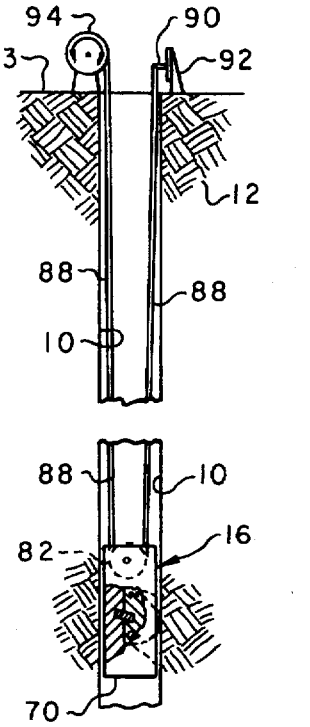
FIG. 3 is a vertical section view of the well illustrated in FIG. 1 showing installation of the casing pulldown anchor.
Figure 4:
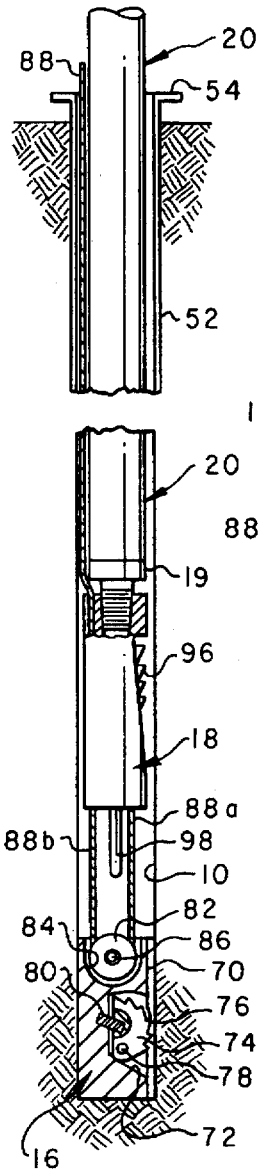
FIG. 4 is a view similar to FIG. 3 showing installation of the casing and casing anchor.

Referring now to FIGS. 3 and 4, FIG. 3 in particular, the pumping system including the pulldown anchor 16, the casing anchor 18, and the casing 20 may be installed by first drilling the wellbore 10 in a conventional manner to the depth desired and then installing the anchor 16. As shown in FIGS. 3 and 4, the anchor 16 comprises a generally cylindrical body 70, slightly smaller in diameter than wellbore 10, and formed of a relatively easily drillable material, such as aluminum or a high strength polymer material, for example. The body 70 includes a recess 72 formed therein for supporting an anchor pawl 74. The pawl 74 has an arcuate array of teeth 76 formed thereon, as shown, and the pawl 74 is mounted on a suitable pivot pin 78 within the recess 72. The pawl 74 is operable to be biased to pivot radially outwardly from the recess 72 by a suitable coil biasing spring 80 disposed on the body 70.

Accordingly, when the pulldown anchor 16 is lowered into the wellbore 10, the pawl 74 may be continuously biased to engage the wellbore wall by the spring 80 so that, if movement upward in the wellbore is attempted, the pawl 74 will forcibly bias the body 70 against the wellbore wall and the teeth 76 will forcibly engage the wellbore wall to prevent upward movement of the anchor 16 in the well.

As shown in FIGS. 3 and 4, the pulldown anchor 16 also includes a rotatable cable sheave 82 disposed in a second recess 84 formed in the body 70 and supported for rotation by a suitable axle member 86, FIG. 4. As shown in FIG. 3, an elongated, flexible cable 88 is reeved around the sheave 82 and extends from the surface 13. The cable 88 is preferably temporarily anchored by a becket 90 to suitable anchor means 92 and the other end of the cable 88 may be reeved over a suitable rotary drum winch 94, for example. Alternatively, the end of the cable opposite the becket 90 may be suitably grasped by a person to allow the pulldown anchor 16 to be lowered into the well and once the pulldown anchor has reached the desired depth, the end of the cable opposite the end 90 may be pulled upwardly to cause the anchor pawl 74 to forcibly engage the wellbore wall and lock the anchor 16 in place in the wellbore. Preferably, the anchor 16 will be lowered to the bottom of the wellbore 10 as shown by the final position of the anchor in FIGS. 1 and 4. Accordingly, the pulldown anchor 16 is lowered into the wellbore 10 by cable 88 until the desired position is reached whereupon the cable end reeved over the winch drum 94, or otherwise held, is pulled upwardly to effect forcible engagement of the pawl 74 with the wellbore wall to lock the anchor 16 in its working position.

Referring further to FIG. 4, after installation of the pulldown anchor 16, the casing anchor 18 is suitably connected to the casing 20 by a coupling member 19 and anchor 18 is also connected to the cable end represented by the becket 90 at the surface 13. The opposite end of the cable 88 is trained through a suitable passage formed in the cable anchor 18 and then either through the casing 20 or along the wellbore 10 between the casing and the wellbore wall. The casing 20 and casing anchor 18 are then lowered into the wellbore 10 and pulled downward by winding the end of the cable 88 opposite the becket 90 around the cable drum 94, or otherwise pulling the end upwardly, to forcibly insert the anchor 18 and the casing 20 into the well. As previously mentioned, the casing 20 is preferably formed of relatively lightweight and somewhat flexible polyethylene pipe. For example, a casing having a nominal inside diameter of about 1.94 inches and a wall thickness of about 0.22 inches may be formed of a grade PE3408, SDR11 polyethylene, such as a type manufactured by NuMex Plastics, Inc. of Roswell, N. Mex.

The strength of the casing required for a pumping installation in accordance with the present invention may be such that a casing normally rated for a certain internal pressure may be used at a higher pressure by reinforcing the casing after installation. For example, the annular space in the wellbore 10 between the outer wall of the casing 20 and the wellbore wall may be filled with a particulate material, such as pea gravel, for example. Other particulate material such as coarse sand or particulate material having about the same particle size as pea gravel may also be used. Once the casing 20 has been installed in the wellbore 10, for example, the annular space 23, see FIG. 9, may be filled with a flowable material including particulate material 25 of the type aforementioned. This filling operation may be carried out after manually tensioning or straightening the casing 20 and before final tightening of the coupling 56 or, the coupling 56 may have a suitable passage therein formed by a slot **56*a*, see FIG. 2. Once the casing 20 has been substantially tensioned and the cable 88 removed from the wellbore, the aforementioned annular space 23 may be filled with particulate material 25** to reinforce the casing and provide for operating the casing at higher internal working pressures than would be possible for a particular casing strength if the annular space between the casing and the wellbore wall was not at least partially filled with the above-mentioned particulate material.

When the casing anchor 18 is pulled downwardly in the wellbore 10 to a position where it is engageable with the pulldown anchor 16, a toothed pawl 96 is released to forcibly engage the wellbore wall to secure the casing anchor 18 in the position shown in FIG. 1. Thus, the lower end of casing 20 is anchored in the wellbore 10 at this time. Engagement of the casing anchor 18 with the pulldown anchor 16 is accomplished by a movable trigger pin 98, as shown in FIGS. 1 and 4. The pin 98 is operable to release the pawl 96 for movement to engage the wall of wellbore 10 and to also effect release of the becket 90 of the cable 88 from the casing anchor 18 in a manner to be described in further detail herein whereupon the cable 88 may be then pulled around the sheave 82 through the aforementioned passage in the anchor 18 and upwardly out of the well. The upper end of casing 20 may then be tensioned by, for example, cutting the casing 20 to a desired length, forming the threaded portion 21 on the casing and securing the coupling member 56 to the casing by threadedly engaging the threaded portion 21 and tightening the threads until the casing is tensioned properly. Other means for securing and tensioning the casing 20 may be utilized, as mentioned previously.

Figure 6:
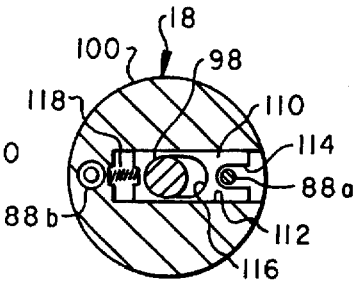
FIG. 6 is a section view taken along the line 6—6 of FIG. 5.
Figure 7:
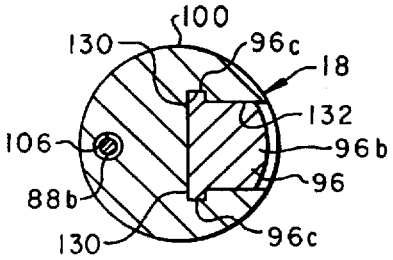
FIG. 7 is a section view taken along the line 7—7 of FIG. 5.
Figure 5:
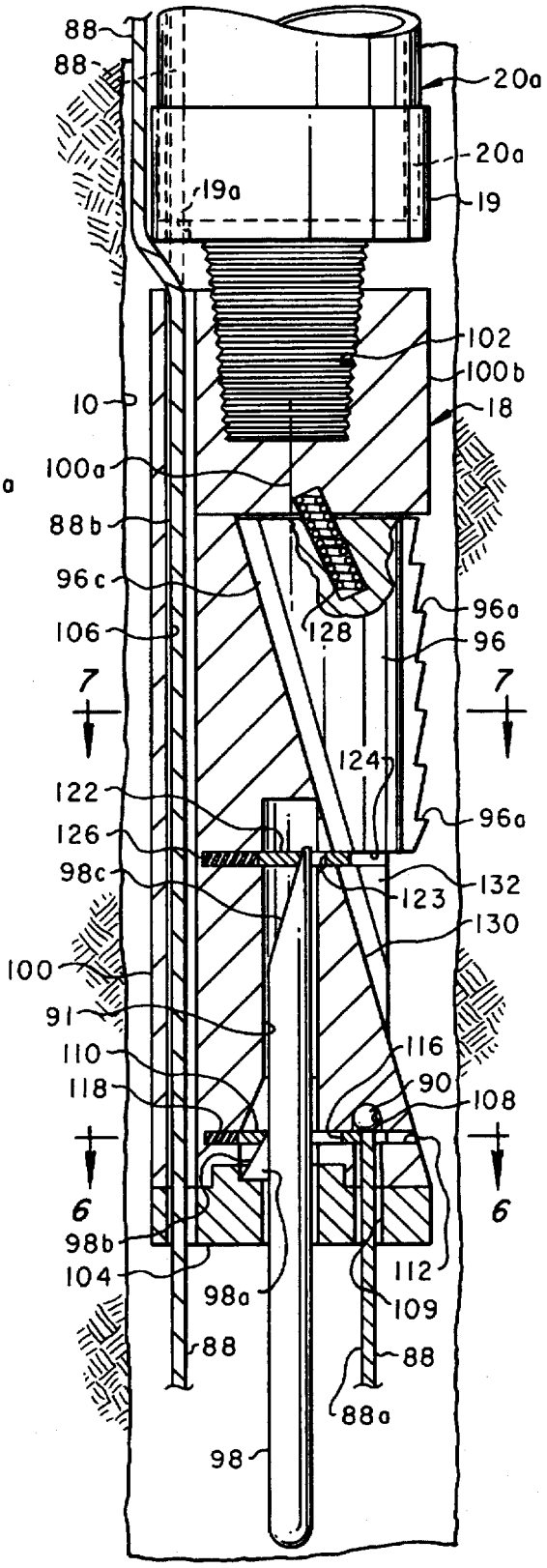
FIG. 5 is a longitudinal central section view of the casing anchor illustrating the anchor pawl and cable release mechanisms.

Referring now to FIGS. 5, 6 and 7, the casing anchor 18 is shown in detail and is characterized by generally cylindrical metal or composite body 100 having a suitable, internally threaded portion 102 formed at its upper end and a removable cover member 104 at its lower end. The threaded portion 102 is threadedly engaged with casing coupling member 19, as shown in FIG. 5, which casing coupling member is suitably secured to the lower distal end **20*a* of casing 20. A suitable threaded connection between coupling member 19 and casing distal end 20*a* may be provided, not shown. The body 100 includes a longitudinal passage 106 extending therethrough for receiving run 88*b* of cable 88, as shown in FIG. 5. As mentioned above the cable may extend within the casing 20 through a passage 19*a* in coupling 19 or externally of the casing, as shown. The lower end of body 100 includes a recess 108 for receiving the becket 90 of cable 88, which is retained in the recess 108 by a retaining member 110. The retaining member 110 is slidably disposed in a transverse slot 112, see FIG. 6, formed in the body 100 and includes a somewhat U-shaped slot 114 formed in one end thereof for receiving cable run 88*a*. The retaining member 110 also includes a slot 116 forming clearance around the pin 98. The pin 98 is disposed in a longitudinal bore 91 formed in the body 100 and is retained in the bore by a radially extending boss 98*a* having a suitable cam surface 98*b* formed thereon as shown in FIG. 5. A coil spring 118 is disposed in the slot 112 and is operable to bias the retaining member 110 in the position shown in FIGS. 5 and 6.. In response to upward movement of the pin 98, viewing FIG. 5, the retaining member 110 is urged to move to the left, viewing FIG. 6, by the cam surface 98*b* engaging the retaining member, until the slot 114 clears the becketed end 90 of the cable 88 whereupon the cable is released to move through passage 109, FIG. 5, to disengage from the cable anchor 18. The becketed end 90 of the cable 88 may then be pulled through the recess 84 in anchor 16, up through passage 106 and out of the wellbore 10** as previously described.

Referring further to FIGS. 5 and 7, the pawl 96 includes spaced apart transverse serrations **96*a*, FIG. 5, which are engageable with the wall of wellbore 10 to forcibly retain the anchor 18 against movement upward in the wellbore when the casing 20 is tensioned. The pawl 96 is maintained in a retracted position by a slidable retainer plate 122, FIG. 5, which is disposed in a transverse slot 124 formed in the body 100, spaced from and generally parallel to the slot 112. The retainer member 122 includes a slot 123 formed therein through which an upper distal end of pin 98 projects slightly, FIG. 5. Retainer plate 122 is engageable with a cam surface 98*c* formed on the upper distal end of pin 98 and is movable against the urging of a spring 126 to a position which will release the pawl 96** for movement under the urging of a biasing spring 128 from the retracted position shown in FIG. 5 to a position in engagement with the wall of wellbore 10 to prevent upward movement of the anchor 18 in the wellbore.

Referring further to FIGS. 5 and 7, the pawl 96 comprises an elongated flat sided body 96*b* having opposed longitudinal flange portions 96*c*, FIG. 7, which are disposed in elongated, opposed slots 130 formed in the body 100. The slots 130 open into and are parallel to a channel 132 in body 100 which journals the pawl body 96 for sliding movement therein and for retention by the flanges 96*c*. The channel 132 extends at an acute angle with respect to the longitudinal central axis 100*a* of body 100 and opens to the body cylindrical sidewall 100*b*. Accordingly, in response to release of the pawl 96 from the position shown in FIG. 5, spring 128 urges the pawl to move within the channel 132 into forcible engagement with the wellbore wall to effectively wedge the body 100 in a predetermined position in the wellbore.

Accordingly, as the casing anchor 18 and the casing 20 are pulled down into the wellbore 10 by the cable 88, when the pin 98 engages the anchor 16, the retaining members 110 and 122 are both actuated to release the cable 88 and the pawl 96, respectively, for causing the anchor 18 to be secured in a predetermined position in the wellbore. The pawl 96 effectively wedges the anchor 18 in the working position shown in FIG. 1 once the casing 20 is pulled upwardly to tension the casing, as described previously.

Once the casing 20 has been anchored in the wellbore 10 and is suitably secured to the wellhead by the coupling member 56, and prior to installation of the wellhead member 60, an assembly of the pump 26, including rod 28, the release valve 44, the tubing anchor 42 and a suitable length of tubing string 46 are lowered within the casing 20 to a predetermined position in proximity to the reservoir or aquifer 14, for example, so that fluid may be lifted by operation of the pump 26 in due course. Once the aforementioned assembly of the pump 26, rod 28, release valve 44 and anchor 42, together with tubing string 46, is positioned in the well the wellhead member 60 is suitably secured to the upper distal end of the tubing 46 and secured to the wellhead 30 in a suitable manner.

Figure 8:
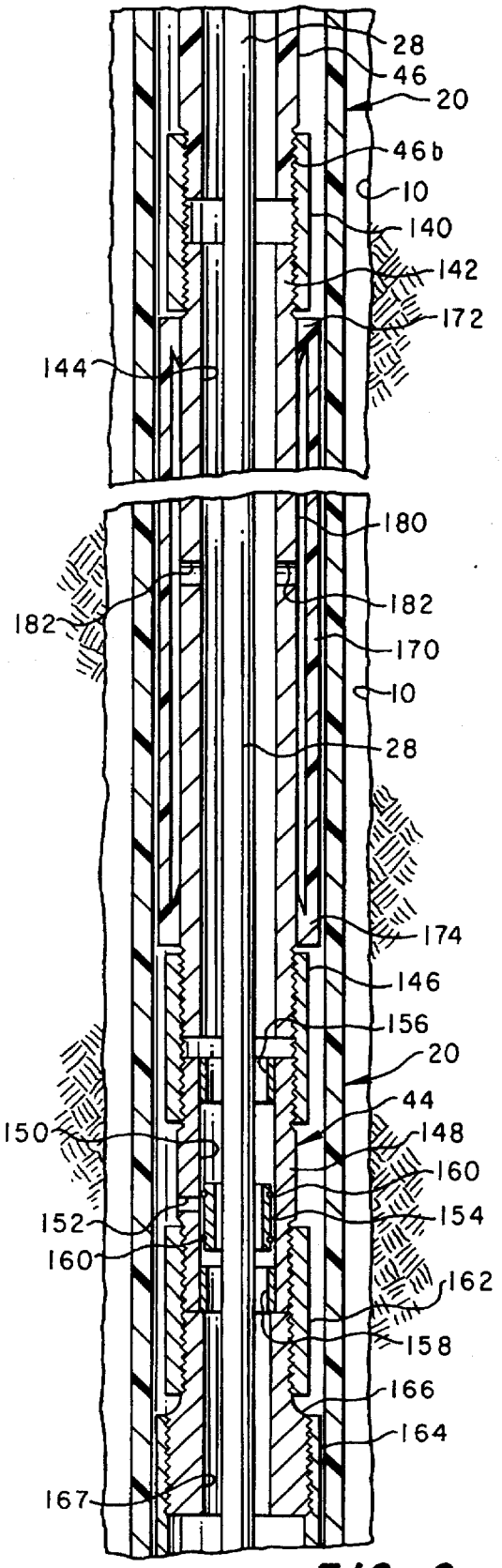
FIG. 8 is a longitudinal central section view of the tubing and pump anchor and release valve.

Referring now to FIG. 8, details of the hydraulically actuated pump and tubing anchor 42 and the release valve 44 are illustrated. The anchor 42 is connected to the lower end 46*b* of tubing string 46 by a suitable threaded coupling member 140 which is threadedly connected to the tubing 46 and to an inner tubular mandrel 142 of the tubing anchor 42. The mandrel 142 has an axially extending central bore or passage 144 formed therethrough forming a continuous passage from the release valve 44 to the tubing string 46. The mandrel 142 is also provided with suitable threads on the end opposite the coupling 140 for connecting the mandrel to a second coupling 146 which is threadedly engaged with a tubular body 148 of the release valve 44. The body 148 has a central axial cylindrical bore or passage 150 formed therein and a transverse passage 152 opening from the exterior of the release valve into the passage 150. An axially slidable tubular closure member 154 is disposed in the bore 152 and is retained therein by opposed tubular retainer members 156 and 158 at opposite ends of the bore. The closure member 154 is provided with suitable elastomeric seal rings 160 disposed thereon and engageable with the bore wall of bore 150 to require forcible movement of the closure member under the urging of a member of pump 26 to be described in further detail herein. The lower end of release valve body member 148 is connected to pump 26 by a suitable internally threaded coupling member 162 which is connected directly to an upper head member 166 of pump 26. The head member 166 is threadedly engaged with an elongated tubular pump barrel or body member 164, as illustrated in FIG. 8.

Referring further to FIG. 8, the hydraulic tubing anchor 42 includes an elongated elastomeric radially distendable annular bladder member 170 disposed around the mandrel 142 and suitably secured thereto at its opposite ends 172 and 174, respectively, in sealing engagement, and defining an annular chamber 180 which is in communication with the bore or passage 144 through suitable radial ports 182 formed in the mandrel 142. The anchor 42 may be actuated by filling the tubing string 46 and the passage 144 with liquid, such as water, with the valve closure member 154 in the closed position whereby the bladder 170 is radially distended into forcible engagement with the casing 20 to anchor the assembly of tubing string 46, anchor 42, valve 44 and pump 26 against unwanted movement within the casing in response to actuation of the pump, for example, by reciprocation of the rod 28. A standing column of liquid in the tubing string 46 above the anchor 42 is typically sufficient to exert enough pressure to distend the bladder 170 in engagement with the casing 20 with enough force to suitably retain the pump 26 and the above-mentioned component assembled therewith in a desired position in the wellbore 10. In this regard, the tubing 46 may be formed of a suitable polymer material such as polyethylene pipe, for example, or be otherwise sufficiently flexible as to not provide for suitable retention of the pump 26 in a desired working position within the well when the pump is being operated, in particular.

Figure 9:
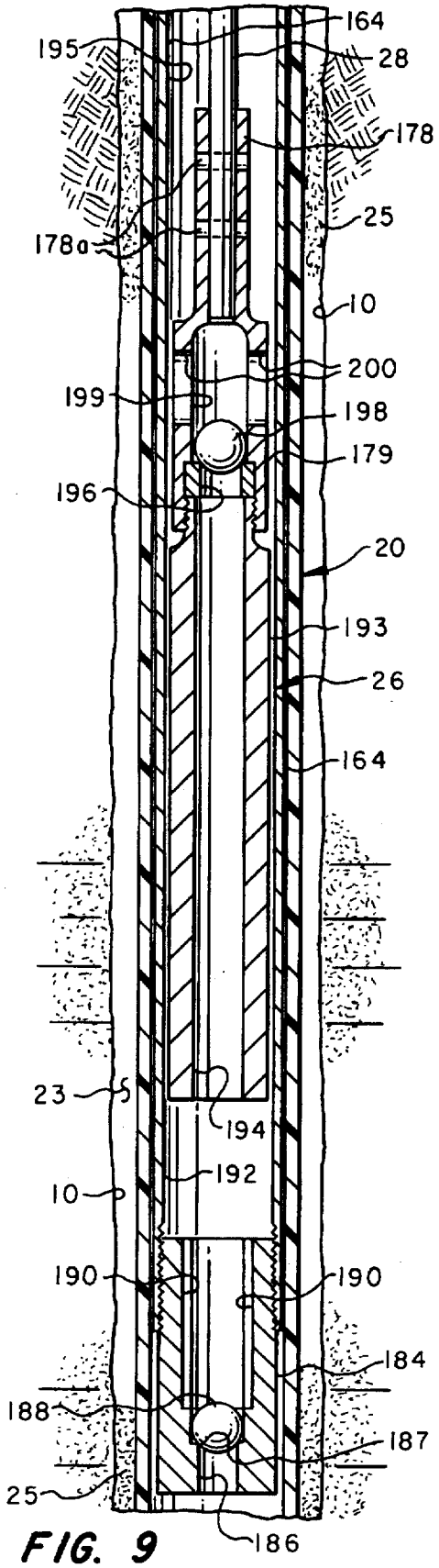
FIG. 9 is a longitudinal central section view of the rod actuated pump of the pumping system.

When it is desired to release the anchor 42, by discharging liquid from the tubing string 46 and the passages 144 and 150, the rod 28 may be moved upwardly, viewing FIGS. 1, 8 and 9, to cause a shank member 178, FIG. 9, connected to the lower end of the rod 28 to move upward through a passage 167 formed in coupling member 166 and through the tubular retainer 158 into engagement with the sleeve-like closure member 154 to move it upwardly to uncover the port 152 allowing fluid to discharge from the tubing string 46, and annular chamber 180 through ports 182 and passage 144 into the casing space 24. The elastic memory of the distendable bladder 170 will cause it to retract radially into the position shown in FIG. 8 whereupon the tubing string 46, the anchor 42, the valve 44 and the pump 26 may be moved within the casing 20 at will.

Referring further to FIG. 9, the pump 26 is further characterized by a lower, generally cylindrical head member 184 threadedly connected to the elongated body or barrel member 164, as shown, and including a central passage 186 having a portion forming a seat 187 for a standing valve closure member 188. The passage 186 is also in communication with longitudinal grooves or passages 190 which open into a cylindrical bore 192 formed in the body member 164. A reciprocable pump piston 193 is disposed in bore 192, is connected to an enlarged diameter portion 179 of shank 178 and includes an elongated central bore 194 opening into bore 192. Piston shank 178 is connected to rod 28 by suitable pins 178*a*, FIG. 9. Piston bore 194 is in communication with an annular valve seat 196 for a traveling valve closure member 198 disposed in a bore 199 in shank 178. In response to downward movement of piston 193, viewing FIG. 9, fluid in bore 192, between valves 188 and 198, is displaced to unseat valve 198 to allow fluid to flow around valve 198 and through ports 200 in the shank 178 and into the bore portion 195 above the piston and defined by the pump barrel member 164. Fluid is displaced upwardly through the bore 195 and the passages 167, 150, 144 and the tubing string 46 in a known manner in response to reciprocation of the piston 193 wherein, during the upstroke of the piston traveling valve 198 closes while displacement of the piston causes valve 188 to unseat to draw liquid into the bore 192 from wellbore space 24. Reciprocation of the pump piston 193 with the rod 28 is thus carried out in a known manner to pump water or other suitable fluids from the wellbore 10.

As described above, when it is desired to remove the pump 26 from the casing 20 or move the pump within the casing to a new position, rod 28 is drawn upwardly until shank 178 engages closure member 154 causing it to open port 152 and discharge all liquid in the aforementioned passages and the tubing string 46 above the release valve 44 into the casing 20 so that the pump may be moved. Once the release valve 44 has been actuated, it may be necessary to remove the valve from the well to reposition the closure member 154 in its working position. Alternatively, a collar may be disposed on pump rod 28 in a position such that when piston 193 is at the bottom of its stroke, just prior to engagement with lower head member 184, the closure member 154 may be repositioned in the position shown in FIG. 8.

The pumping system of the invention may be fabricated using conventional engineering materials and methods known to those skilled in the art of well pumps and the like. However, the pumping system of the invention advantageously uses relatively lightweight polymer materials for the casing 20 and for the tubing string 46, for example. The materials used in fabricating the coupling 19, the anchor 18, and the anchor 16 may also be of relatively easily machinable metals or other materials which are capable of being drilled out by a rotary earth drilling apparatus so that, in the event the wellbore 10 is to be deepened, these members may be sacrificed and replaced once the new well depth has been achieved.

Although an improved well pump system and method of installation have been described in detail herein, those skilled in the art will recognize that various substitutions and modifications may be made to the invention without departing from the scope and spirit of the appended claims.

What is claimed is:

1. A well pump system for installation in a wellbore penetrating an earth formation, said pump system comprising:

a casing pulldown anchor disposed in said wellbore in a predetermined position;

a casing anchor disposed in said wellbore between said pulldown anchor and the earth's surface;

an elongated tubular casing connected to said casing anchor and extending toward the earth's surface; and a pump disposed in said casing and operable to be in communication with fluid flowing into said casing from a fluid producing zone in said earth formation.

2. The pump system set forth in claim 1 wherein:

said pump includes a reciprocating piston disposed therein and elongated rod means connected to said piston and extending to the earth's surface for reciprocating movement to effect pumping fluid from said wellbore.

3. The pump system set forth in claim 2 including:

an elongated tubing string extending within said casing and in communication with said pump and a pump anchor interposed in said tubing string between said pump and the earth's surface, said pump anchor including pressure fluid actuated means for engaging said casing to retain said pump anchor and said pump in a predetermined position in said well.

4. The pump system set forth in claim 3 wherein:

said pump anchor includes a radially distendable bladder member operable to be distended under the urging of pressure fluid acting thereon to forcibly engage said casing to retain said pump anchor and said pump in said predetermined position.

5. The pump system set forth in claim 4 including:

a release valve interposed between said pump and said pump anchor including a movable closure member operable to be moved to a position to discharge pressure fluid from said pump anchor to release said pump anchor from forcible engagement with said casing.

6. The pump system set forth in claim 5 wherein:

said pump anchor includes an elongated mandrel having a central passage formed therein and in communication with said tubing string and with a chamber formed in said pump by way of a passage formed in said release valve;

said bladder is disposed around said mandrel and forms a chamber for receiving fluid therein and said mandrel includes port means in communication with said chamber and said passage in said mandrel for communicating pressure fluid to distend said bladder into forcible engagement with said casing; and said pump includes a member operable to engage said closure member on said release valve to move said closure member to discharge liquid from said passage in said mandrel and said chamber to release said pump anchor from forcible engagement with said casing.

7. The pump system set forth in claim 1 wherein:

said pulldown anchor includes a body member, means mounted on said body member and movable into forcible engagement with a wall of said wellbore; and means for receiving a flexible cable to be connected to said body member for positioning said body member in said wellbore and said means engageable with said wall of said wellbore is operable to forcibly engage said wall of said wellbore wall to effect retention of said pulldown anchor in said wellbore in response to tensioning said cable.

8. The pump system set forth in claim 7 wherein:

said pulldown anchor includes a rotatable sheave mounted on said body member and operable to have a flexible cable reeved therearound for lowering said pulldown anchor into said well and for effecting movement of said pulldown anchor to engage said wall of said wellbore in response to tensioning said cable.

9. The pump system set forth in claim 1 wherein:

said casing anchor includes an anchor body and means mounted on said anchor body and movable relative thereto for engagement with said wall of said wellbore to retain said casing anchor in a predetermined position in said wellbore; and means on said anchor body for releasably connecting said casing anchor to a flexible cable whereby said casing anchor may be pulled into said wellbore to a predetermined position.

10. The pump system set forth in claim 9 wherein:

said means on said anchor body engageable with said wall of said wellbore includes a movable pawl member mounted on said anchor body and biasing means engageable with said pawl member for urging said pawl member into engagement with said wall of said wellbore.

11. The pump system set forth in claim 10 wherein:

said casing anchor includes an actuating member for effecting movement of said pawl member from a retracted position to a position in forcible engagement with said wall of said wellbore, said actuating member being operable to be actuated in response to engagement with means in said wellbore upon moving said casing anchor into said wellbore.

12. The pump system set forth in claim 11 wherein:

said casing anchor includes a retainer member engageable with said actuating member and responsive to movement of said actuating member to release said pawl member for movement with respect to said anchor body to engage said wall of said wellbore.

13. The pump system set forth in claim 12 wherein:

said casing anchor includes a second retainer member engageable with an end of said flexible cable and responsive to movement of said actuating member to release said cable for retrieval from said wellbore.

14. The pump system set forth in claim 13 wherein:

said casing anchor includes passage means extending therethrough for receiving a run of said flexible cable for traversal of said flexible cable through said casing anchor during installation of said casing anchor in a wellbore.

15. The pump system set forth in claim 1 including:

means connected to said casing for holding said casing in a substantially straight position in said wellbore.

16. In a pump system for installation in a well penetrating an earth formation, apparatus comprising:

a pulldown anchor operable to be lowered into a wellbore for said pump system, said pulldown anchor including a body member, means for receiving a flexible cable connected to said body member for lowering said pulldown anchor into said wellbore and means for engagement with a wall of said wellbore to substantially prevent movement of said pulldown anchor upwardly in said well;

a casing anchor adapted to be lowered into said well, said casing anchor including an anchor body and means mounted on said anchor body for movement to a position to engage said wellbore wall to forcibly retain said casing anchor in said well;

an elongated casing having a lower end thereof connected to said casing anchor; and means for connecting a flexible cable to said casing anchor for pulling said casing anchor into said well with said cable trained through said means for receiving said cable on said pulldown anchor whereby said casing is operable to be positioned in said well upon pulling said casing anchor and said casing into said well with said cable.

17. The apparatus set forth in claim 16 including:

means for securing said casing in a substantially straight and tensioned condition at a wellhead for said well.

18. The apparatus set forth in claim 17 wherein:

said casing includes means connected to an upper end of said casing and engageable with said wellhead for retaining said casing in a substantially straight and tensioned position in said well.

19. The apparatus set forth in claim 18 wherein:

said casing is formed of a flexible pipe selected from a group including a metal and a polymer material.

20. The apparatus set forth in claim 16 wherein:

said means for receiving said flexible cable includes a rotatable sheave mounted on said body member and operable to support said cable reeved therearound for lowering said pulldown anchor into said well and for effecting movement of said pulldown anchor to engage a wall of said wellbore in response to tensioning said cable.

21. The apparatus set forth in claim 16 including:

means on said anchor body for releasably connecting said casing anchor to said cable.

22. The apparatus set forth in claim 16 wherein:

said means on said anchor body engageable with said wellbore wall includes a movable pawl member mounted on said anchor body and biasing means engageable with said pawl member for urging said pawl member into engagement with said wellbore wall.

23. The apparatus set forth in claim 22 wherein:

said casing anchor includes an actuating member for effecting movement of said pawl member from a retracted position to a position in forcible engagement with said wellbore wall, said actuating member being operable in response to engagement with means in said wellbore upon moving said casing anchor into said wellbore.

24. The apparatus set forth in claim 23 wherein:

said casing anchor includes a retainer member engageable with said actuating member and responsive to movement of said actuating member to release said pawl member for movement with respect to said anchor body to engage said wellbore wall.

25. The apparatus set forth in claim 24 wherein:

said casing anchor includes a second retainer member engageable with an end of said cable and responsive to movement of said actuating member to release said cable for retrieval from said well.

26. The apparatus set forth in claim 25 wherein:

said casing anchor includes passage means extending therethrough for receiving a run of said cable for traversal of said cable through said casing anchor during installation of said casing anchor in a wellbore.

27. A well pump system for installation in a wellbore penetrating an earth formation, said pump system comprising:

an elongated tubing string extending from a wellhead into said wellbore;

a pressure fluid actuated pump anchor connected to said tubing string;

a release valve operably connected to said pump anchor; and a fluid lifting pump operably connected to said tubing string in such a way that said release valve is interposed between said pump anchor and said pump;

said pump anchor including a member operable to be biased into forcible engagement with a wall of said wellbore in response to pressure fluid acting thereon for retaining said tubing string and said pump in a predetermined position in said wellbore.

28. The pump system set forth in claim 27 wherein:

said release valve includes a movable closure member operable to be moved to a position to discharge pressure fluid from said pump anchor and said tubing string to release said pump anchor from forcible engagement with said wellbore wall.

29. The pump system set forth in claim 28 wherein:

said pump includes a reciprocating piston disposed therein;

an elongated actuating rod connected to said piston and to actuating means at the earth's surface for actuating said pump; and means associated with said actuating rod for engaging said closure member to cause said release valve to be in a valve open position.

30. The pump system set forth in claim 27 wherein:

said pump anchor includes an elongated tubular mandrel and said member operable to be in forcible engagement with said wall comprises a radially distendable bladder member disposed on said mandrel and forming a pressure fluid chamber therebetween.

31. A method for installing a pump system in a well comprising an elongated wellbore extending within an earth formation, said method comprising the steps of:

lowering a pulldown anchor into said wellbore and securing said pulldown anchor at a predetermined position in said wellbore;

moving a casing anchor into said wellbore by pulling said casing anchor into said wellbore with flexible means engaged with said pulldown anchor, said casing anchor being connected to one end of an elongated casing; and causing said casing anchor to be anchored in said well at a predetermined position while connected to said casing for retaining said casing in said well.

32. The method set forth in claim 31 including the step of:

tensioning said casing in said wellbore after installation of said casing anchor.

33. The method set forth in claim 31 including the step of:

connecting said casing to a wellhead for retaining said casing in a substantially straight and tensioned condition.

34. The method set forth in claim 31 wherein:

the step of lowering said pulldown anchor comprises lowering said pulldown anchor into said wellbore on elongated flexible cable means, said cable means being anchored adjacent said wellbore at the earth's surface at one end of said cable means, the other end of said cable means being operable to be tensioned to cause said pulldown anchor to engage a wall of said wellbore to retain said pulldown anchor in said wellbore.

35. The method set forth in claim 34 including the step of:

connecting one end of said cable means to said casing anchor and pulling said casing anchor and a length of casing connected thereto into said wellbore by pulling on said cable means, and causing said casing anchor to forcibly engage said wellbore wall at a predetermined position in said wellbore.

36. The method set forth in claim 35 including the step of:

causing said casing anchor to engage said pulldown anchor to effect release of said cable means from said casing anchor and to effect release of a pawl member mounted on said casing anchor to engage said wellbore wall to retain said casing anchor in said wellbore.

37. The method set forth in claim 31 including the step of:

lowering a pump assembly into said casing, said pump assembly including a reciprocable piston pump, an elongated pump rod connected thereto and means for retaining said pump in said wellbore in a predetermined position.

38. The method set forth in claim 37 wherein:

said pump assembly includes a tubing string connected to said means for retaining said pump in said wellbore and said means for retaining said pump in said wellbore includes pressure fluid actuated means engageable with said wellbore wall; and said method includes the step of actuating said means for retaining said pump in said wellbore by at least partially filling said tubing string with pressure fluid.

39. The method set forth in claim 38 wherein:

said pump assembly includes a release valve for said means for retaining said pump in said wellbore and said method includes the step of:

causing said means for retaining said pump in said wellbore to release engagement with said wellbore wall by actuating said release valve with said pump rod.

40. The method set forth in claim 31 including the step of:

at least partially filling an annular space between a wall of said wellbore and said casing with material to reinforce said casing in said wellbore.

* * * * *